United States Patent [19]

Ahlers et al.

[11] 4,386,635

[45] Jun. 7, 1983

[54] METHOD FOR CONTROLLING ELECTRICALLY CONTROLLED FILLING ELEMENTS AND SYSTEM FOR CARRYING OUT THE METHOD

[75] Inventors: Egon Ahlers, Neu-Bamberg; Hermann Schlosser, Bad Kreuznach, both of Fed. Rep. of Germany

[73] Assignee: Seitz-Werke GmbH, Bad Kreuznach, Fed. Rep. of Germany

[21] Appl. No.: 240,257

[22] Filed: Mar. 4, 1981

[30] Foreign Application Priority Data

Mar. 12, 1980 [DE] Fed. Rep. of Germany ..... 3009405

[51] Int. Cl.[3] ..... B65B 3/26

[52] U.S. Cl. ..... 141/6; 141/40; 141/198; 141/302; 141/DIG. 1; 137/392; 340/236

[58] Field of Search ..... 141/4–7, 141/37, 39–64, 94, 95, 96, 191–229, 291–310, DIG. 1; 340/236; 137/392

[56] References Cited

U.S. PATENT DOCUMENTS 3,633,635 1/1972 Kaiser ..... 141/40

*Primary Examiner*—Houston S. Bell, Jr.

*Attorney, Agent, or Firm*—Becker & Becker, Inc.

[57] ABSTRACT

A method and system for controlling electrically controlled filling elements in bottle filling machines for filling liquids into containers by opening a liquid flow valve, and including at least one signal emitter responding at a predetermined liquid level to the liquid in the container to be filled. After response to the signal emitter, the liquid flow valve is closed with a time delay under the influence of a correction factor. A system for carrying out the foregoing method has associated with each filling element a correction element connected to the signal emitter of the filling element, with the output signal thereof acting on a control unit which in turn acts on the liquid flow valve.

27 Claims, 7 Drawing Figures

Diff
Jnf
On
Off
Sync.
D
D1
D2
E
1
2
3
4
5
6
7
8
9
10
21
22
23
31
32
33
100
101
102
103
104
105
106
107
108
109
110
111
112
113
114
115
116
117
118
119
120
121
122
123
124
125
126
127
128
129
130

METHOD FOR CONTROLLING ELECTRICALLY CONTROLLED FILLING ELEMENTS AND SYSTEM FOR CARRYING OUT THE METHOD

The present invention relates to a method for controlling electrically controlled filling elements in filling machines, as well as a system for carrying out the method, particularly in filling machines for filling liquids into containers by opening a liquid flow valve, and including at least one signal emitter responding to the liquid at a predetermined filling height in the container.

Reliably and accurately operating filling elements are a prerequisite for optimum filling results, and hence for the optimum operation of filling machines. U.S. Pat. No. 3,633,635 Kaiser issued Jan. 11, 1972, belonging to the assignee of the present invention, and incorporated herein by reference discloses, for example, a filling element of the indicated type. This filling element, for a single or multi-chamber counterpressure filling machine, includes a filling tube extending into the pressed-on container; the filling element also includes a signal emitter which triggers the closing pulse for the liquid flow valve and is capable of being influenced by the liquid level rising at a predetermined height in the interior of the container. When, with this filling element, the liquid level rising in the container establishes contact with the signal emitter during intermittent opening of a gas outlet valve actuated by magnets for an accelerated return gas discharge, a generated electrical control signal effects switching-on of an electromagnet included in the valve actuating device. This valve actuating device returns the opened liquid flow valve into the closed position counter to the effect of an opening spring, and maintains the closed position until the pressurizing of the subsequent container. During this container pressurizing, the liquid flow valve, which closes against the counter effect of the opening spring, maintains the closed position solely under the influence of the liquid pressure prevailing in the interior of the element.

The several filling elements of a filling machine, however, unavoidably show deviations. Additionally, different external parameters influence the filling process, as for example the temperature of the filling liquid, differing types of containers, and different filling speeds. These deviations and external parameters cause different filling heights to occur in the individual containers to be filled. It is, however, the goal of every filling process, aside from a safe and disturbance-free manner of operation of the filling machine, to attain an accurate and uniform filling of the containers.

It is an object of the present invention to provide a method of and a system for controlling the electrically controlled filling elements of a filling machine, with which a filling of the containers is attained which is as accurate and uniform as possible.

This object, and other objects and advantages of the present invention, will appear more clearly from the following specification in connection with the accompanying drawings, in which.

Figure 7:
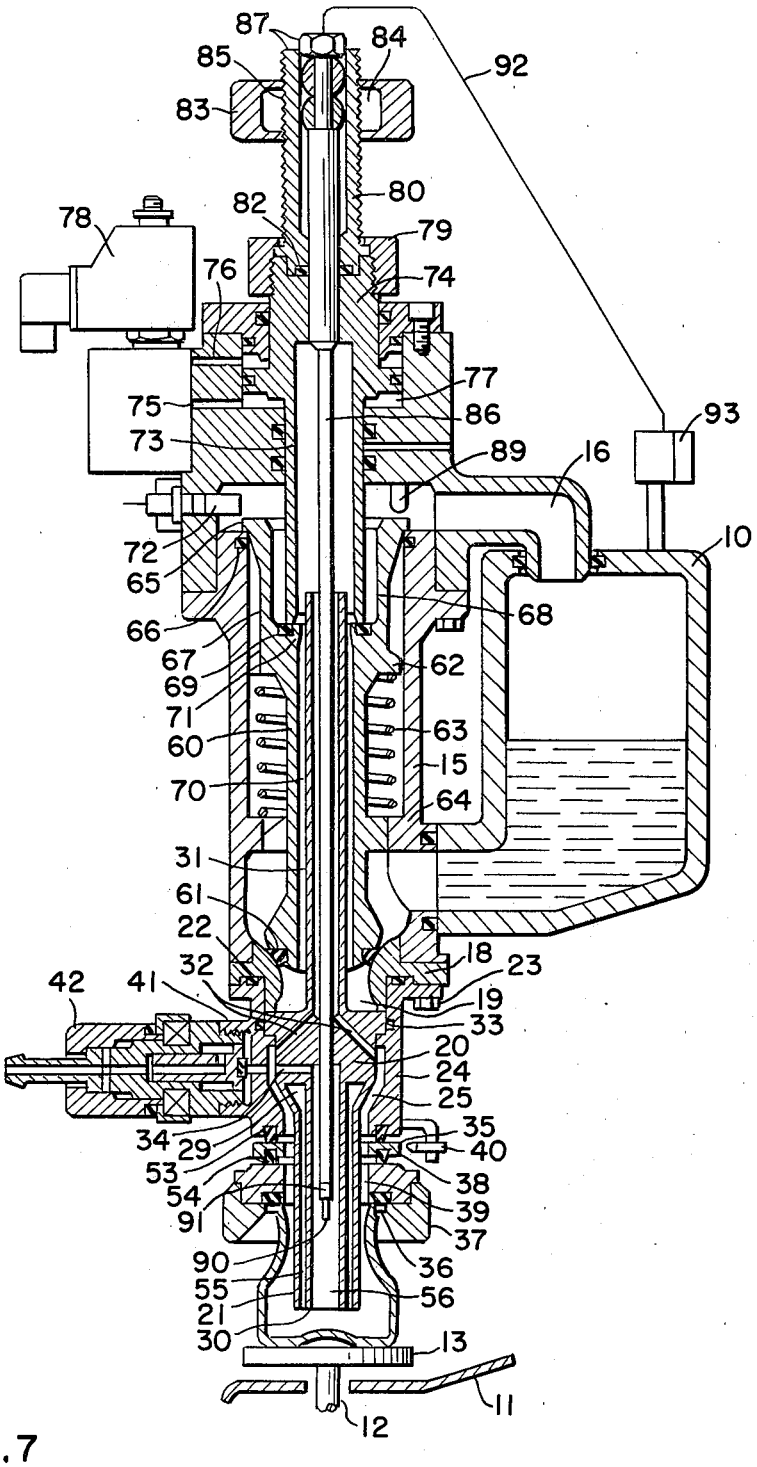
FIG. 7 is a section through a filling element of the prior art, which filling element has structure in common with the filling element utilized in the instant invention.

Referring now to FIG. 7, where a filling element 210 in accordance with the prior art as exemplified by U.S. Pat. No. 3,633,635 (incorporated herein by reference) is shown, the prior art filling element functions as follows in combination with a conventional, rotating filling machine.

When probes 286,290 of all filling elements 210 are adjusted individually by hand by means of a control wheel 283, or are adjusted in common by means of a drive 297,298, for the required filling height in the respective vessels, these vessels will, after the machine has been turned on by means of a customary feeding turnstile, move onto lifting members 212. In the course of the upward movement of the lifting members 212, when viewing an individual filling element 210, the vessel is first centered by the centering member 237 while the filling pipe 221, the rise 230 and the probe 286,290 are introduced into the interior of the vessel. During further upward movement of the vessel, the centering member 237 lifts the intermediate member 235 and together with the latter eventually engages the filling pipe fitting 224. When in this position, the vessel is pressed against the rubber seal 236 of the centering member 237. At the same time, the annular gaps 225,238 and 239 form a passage which communicates with the interior of the vessel which is closed with respect to the outside by seals 253 and 254.

The switch 240 which is controlled by the intermediate member 236 during the upward movement of the vessel will, through control means of the card 293, energize the magnetic valve 278 which opens the inlet 275 to permit the liquid medium to enter the chamber 277. With the beginning of the upward movement of the piston 274, the valve body 273 is lifted off the seat 269 so that tension gas will flow into the vessel from the filling container 210 through conduit 216 and flow through the opened tension gas valve 269,273, the gas pipe 231, the bores 232 and the annular passage 225,238,239. Tension gas furthermore passes through bore 234 and riser 231 into the vessel while liquid residues which may remain in the probe 286,290 are blown off.

When approximate equilibrium has been established between the tension gas pressure in the vessel and in the filling container 210, the spring 263 opens the liquid control valve 218,260. The valve body 260 which has been moved upwardly will, by means of its extension 265, engage the abutment 289 while the tension gas valve 269,273 further remains open. In the course of the upward movement of the valve body 260, its extension 265 also controls an approximation switch 272 which brings about the movement of the probe 286,290 into position of readiness due to control of the card 293. Through the opened liquid control valve 218,260, and without affecting the probe 286,290, the filling medium passes through the opening 219 and the guiding means 227 and 228 of the liquid distributor 220 and enters the vessel. The tension gas displaced in this way returns through the annular passage 225,228,239, the bores 232, the pipe 231, the opened valve 269,273, the recess 268 and the conduit 260 into the gas chamber of the filling container 210. Also the tension gas in the riser 230 escapes through bore 234 into the annular passage 235,238,239 through the tension gas path 232,231, the open valve 269,273 and the passage 268,216 into the filling container 210.

When the liquid level which rises in the riser 230 reaches the feeler 290, the latter signals the control means of the card 293, which control means is associated with the magnetic valve 278. The magnetic valve 278, which has again been actuated, blocks the flow of the liquid to the inlet 275 and connects the latter to the atmosphere. Piston 274, which is acted upon by the liquid due to the simultaneously opened inlet 276, moves the valve body 273 onto the seat 269 and subsequently moves the valve body 260 back to the seat 218 so that the tension gas valve 269,273 and the liquid control valve 218,260 are closed. The magnetic valve 242 is energized after an adjusted or set time has expired. This opens the bore 247 which communicates with the annular passage 225, 238, 239 and the riser 230 due to the change in the position of its valve body 245. As a result, the gas chambers communicating with the pressed-on vessel will, through the gas passage 243,249,248,250 and 251, drop the gas pressure to atmospheric pressure. During the subsequent removal or withdrawal of the vessel from the filling element 210 by lowering the lifting element 212, the centering member 237 and the intermediate member 235 again occupy their starting position. In this connection, the intermediate member 235 moves out of the range of the approximation switch 240 which, by control of the card 293, places the magnetic valve 242 into the currentless position. In view of the effect of spring 244, the valve body 245 thereof will close the bore 247.

The method according to the present invention is characterized primarily in that, after response of the signal emitter, the liquid flow valve is closed with a time delay under the influence of a correction factor $t_v$ which differs from U.S. Pat. No. 3,633,635 that discloses no time delay or correction factor.

According to further advantageous embodiments of the present inventive method, the correction factor $t_v$ may be individually assigned to each individual filling element, or it may be assigned to all the filling elements of the filling machine. One or more other correction factors may be associated with the correction factor $t_v$ in each individual filling element for other correction tasks to be fulfilled. The one or more correction factors for other correction tasks may be provided in a partial range assigned individually in each individual filling element, and the correction factor $t_v$ may be provided in a partial range which is common for all filling elements of the filling machine. The correction-factor partial ranges may be changed as a function of external parameters. The individual filling elements may be connected to an electronic control unit and may be cyclically operated under fixed-cycle control, whereby within the time interval for filling a filling container below a filling element, a plurality of timing cycles will transpire, and the one or more delay members, which are selectively tripped or actuated by the common electronic control unit, and are associated with the correction element assigned to each filling element, are influenced by the parameters which serve as rated values and are compared in the electronic calculator unit with the respectively detected actual values. Individual parameters, including for example the rated value for the speed of rising of the liquid in the container, may be prescribed for each filling element. Also, parameters may be prescribed in common for all filling elements, including for example rated values for the temperature, the type of bottles or containers, and the liquid pressure. The external parameters may be changed in every timing cycle, and may be taken over at the end of the cycle for the following timing cycle. Within the time period for filling a container, one timing cycle may be used in fixable time intervals for feedback transmission to the electronic control unit. A testing of the parameters for changes and transmission errors may be affected by comparison with the previously stored parameters, such comparison being undertaken by the electronic control unit. The transmitted data of one timing cycle may be tested for transmission disturbances with longer lines or conduit paths by way of a two of three-comparison. The data concerning the operating condition of the filling element may be transmitted from the timing cycles to form a closed control circuit for a portion arranged in the filling machine, or for a control device, for instance a pump, arranged externally of the filling machine. All filling elements of a filling machine may be operated sequentially, with an operating cycle including a group with a selectable number of filling elements, and several groups may be operated synchronously.

For the filling elements of all groups, three time-data blocks, which are applicable for the operation of one filling element or for an operating cycle, may be preset as follows:

$B_1$ = time from the beginning of filling until the beginning of rapid filling;

$B_2$ = time from the beginning of filling until the end of rapid filling; and $B_3$ = time from occupying or seizing of the probe until closing of the filling element.

The operating sequence of a filling element may correspond to one timing cycle, and after traversing an operating cycle, the next timing cycle is provided with the renewed operating of the particular filling element, whereby the number of timing cycles represents the time-actual-value.

The inventive solutions make possible an accurate and uniform filling of the containers while taking into consideration the deviations occurring in the individual filling elements of a filling machine, and the external influences arising during the filling process.

An inventive system for carrying out the inventive method is characterized in that each filling element has associated therewith a correction element connected to the signal emitter of the filling element, with the output signal of the correction element acting on a control unit which in turn acts on the liquid flow valve.

A second inventive system for carrying out the inventive method is characterized primarily in that each filling element has associated therewith a manually adjustable correction element with several correction members, whereby, for example, one member has assigned thereto the factor "time" as a correction factor, and the remaining members each have assigned thereto a different correction task, for example the equalization or balance with the remaining filling elements.

A further inventive system for carrying out the inventive method is characterized primarily in that, of the several correction members of the correction element associated with each filling element, selectively one or more correction members are controlled by the control signals of a control unit which is common for all filling elements.

According to further supplementary systems for carrying out the inventive method, one correction element with one or more correction members may be assigned in common to all the filling elements, and one common control unit may be assigned thereto for actuating or controlling the correction members.

The signal emitter of the filling element may be connected not only with a correction element, but also with an electronic control unit, and furthermore the output side of the correction element may be connected to a magnet for the liquid flow valve which operates the filling element, and to a magnet which actuates a gas outlet valve, with the input side of the correction element being connected to the electronic control unit. The signal emitter may be connected with the input of an input/output control member by way of the correction element, and this control member, at the output side thereof, may actuate not only the magnet of the liquid flow valve for the filling element, but also the magnet for the gas outlet valve, and may be connected by way of a date delivery and feedback line with a central processor controlled by a cycle or pulse generator. A programmable fixed value memory and a recorder/reader memory (random access memory) may be connected to the central processor. The central processor may be connected by way of a regulator and an adjustment member with a parameter emitter which in turn is connected to the input of the central processor.

With these inventive systems, an adjustable filling height correction is attained when filling the containers, which correction also takes into consideration external influences and presettable parameters, as well as unavoidable deviations of the individual filling elements.

Figure 1:
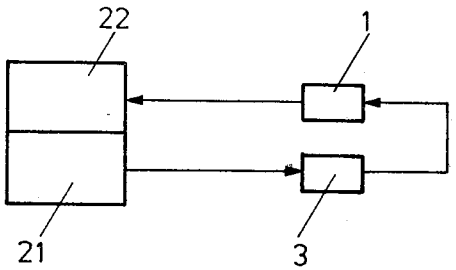
FIG. 1 is a block diagram of one inventive embodiment for control of an electrical filling element with a correction element.

Referring now to the drawings in detail, block diagram of FIG. 1 for control of a filling element in accordance with the present inventive method includes a signal emitter 21, which responds to the filling level in the container and delivers a signal to a correction or adjustment element 3 upon attaining a predetermined filling level. This correction element 3 acts on a control unit 1, which is provided individually for each individual filling element, and which controls the actuating device 22 for the liquid flow valve of the respective filling element. The correction element 3, after response of the signal emitter 21, forwards or transmits the signal given off thereby, delayed in time by a correction factor $t_v$, to the control unit 1, which then initiates the closing of the liquid flow valve with a delay in time relative to the signal delivered by the signal emitter 21.

The assignment of one or more correction elements to the individual filling elements of a filling machine can, for example, be made in such a way that each individual filling element has assigned thereto an individual correction element, and hence an individually adjustable correction factor.

If an individual adjustment capability is not necessary, one correction element in common for all filling elements, and accordingly one common correction factor, can also be provided.

Figure 2:
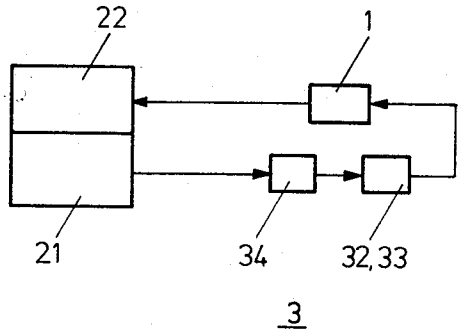
FIG. 2 is a block diagram for control of an electrical filling element with a correction element comprising two correction members.

With the same elements as in FIG. 1, the block diagram illustrated in FIG. 2 shows a subdivision of the correction element 3 into two individual correction members or elements 32/33, and 34. In an analogous manner, if necessary, also a multi-stage subdivision into individual correction elements is possible. In this way, it is possible that the correction factor assigned to each individual filling element can be subdivided, for example, into a partial range which is in common for all filling elements, and into an individual partial range assigned to each filling element. Such a division of the correction factor for different correction tasks may become necessary when different external parameters influence the filling process, in which connection these external parameters occur in a different manner and magnitude at the individual filling elements. In such cases it is expedient, in a further development of the present invention, to change particular correction factor partial ranges as a function of the larger parameters.

A presettable individual parameter for each filling element is, for example, the rated value for the rising-speed of the liquid in the filling container.

Parameters which are in common for all filling elements and which can be preset by common correction members are, for example, the rated values for the temperature, the type of bottles or containers, and the liquid pressure.

Not only in this embodiment, but also in the previously mentioned embodiment, the control unit 1 can be provided in common for all filling elements, and all correction elements, or for the one correction element. However, it is also within the scope of the present invention to combine filling elements in groups with their individual correction elements, or with correction elements assigned thereto in groups, under one control unit, and selectively all control units under one central control unit.

Figure 3:
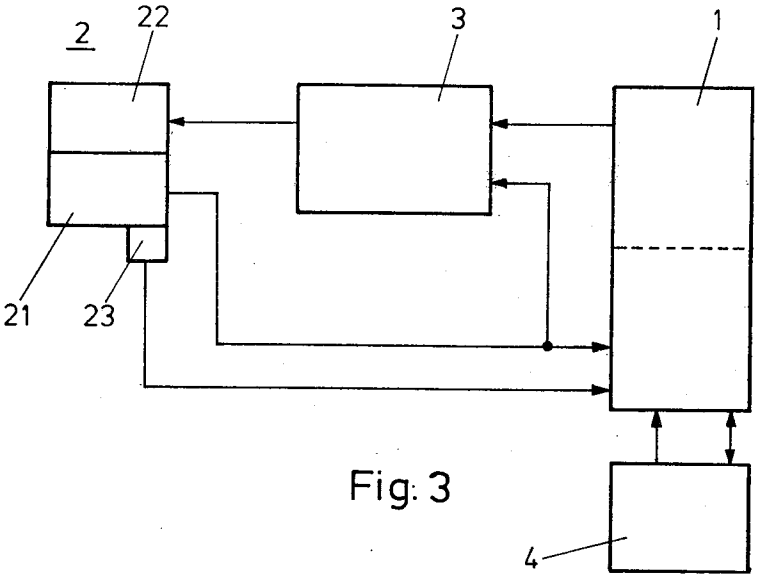
FIG. 3 is a block diagram for control of electrical filling elements with a correction element capable of being influenced by an electronic control unit.

The block diagram for control of electrically controlled filling elements illustrated in FIG. 3 shows only one of several filling elements 2 of a rotating counter-pressure filling machine, which is not illustrated in greater detail. The filling element 2 includes a signal emitter which responds to the filling height in the container and is in the form of a probe 21 introduceable into the container. The filling element 2 also includes a magnet 22 of the actuating device for the liquid flow valve, as well as a magnet 23 for the actuating device of a gas outlet valve for accelerated return gas discharge. The probe 21 transmits its measuring data both to a correction element 3 and also to an electronic control unit 1. This electronic control unit 1 includes a fixed-cycle control as well as a control and calculator mechanism, and is connected in direct reciprocal or two-way connection with an input or detection member for certain individual parameters 4. The electronic control unit 1 has its output side connected to that correction element 3 which acts on the magnet 22 of the filling element 2.

On the basis of this block diagram, the following manner of operation results with the present inventive method:

The correction members 3 associated with the individual filling elements 2 are addressed in common by the fixed-cycle control. The momentary condition of each filling element is hereby sensed by the probe 21 and is compared with the stored preset data in the control and calculator mechanism. Subsequently, the corrected and in their time sequence precise actuating signals are emitted by the correction member 3 for closing the liquid flow valve of the filling element 2. In the simplest situation, the filling height in the filling container is corrected by way of a delayed closing of the liquid flow valve after response of the probe 21. Such a correction factor would not at all take into consideration any deviations of the individual filling elements and no external influences. For permitting the deviations of the filling elements to be incorporated into the correction of the filling height, the correction factor is divided into a partial range associated with each filling element, and a partial range common to all filling elements. In this case, both correction ranges can be changed by the presetting of external parameters.

The utilization of a fixed-cycle control included in the electronic control unit 1 makes possible the computer or calculator-effected change of the two correction ranges, since, with a cyclical processing of the individual filling elements, the respective important data are available early enough. In this manner, for instance the liquid pressure, the temperature of the filling material, and the type of container used can be processed as common parameters, and the rising-speed of the liquid along the probes can be processed as an individual parameter. In the time period needed for filling a filling container below a filling element, accordingly, a plurality of timing cycles is traversed. Changes of the external parameters, and accordingly of the correction factors, can be undertaken in each of these timing cycles. The changes are taken over at the end of the cycle for the following timing cycle.

Additionally, in a further development of the present invention, during the time period of filling a container, a timing cycle can be used in fixable time intervals or at recall for retransmittal to the electrode control unit.

A known 2 of 3-comparison of the signals is available for the transfer of the signals along longer transfer paths. According to this known method, three consecutive signals are compared with each other, and two equal signals are presumed to be the correct signal. In this manner transmission disturbances can be eliminated with great certainty.

Figure 4:
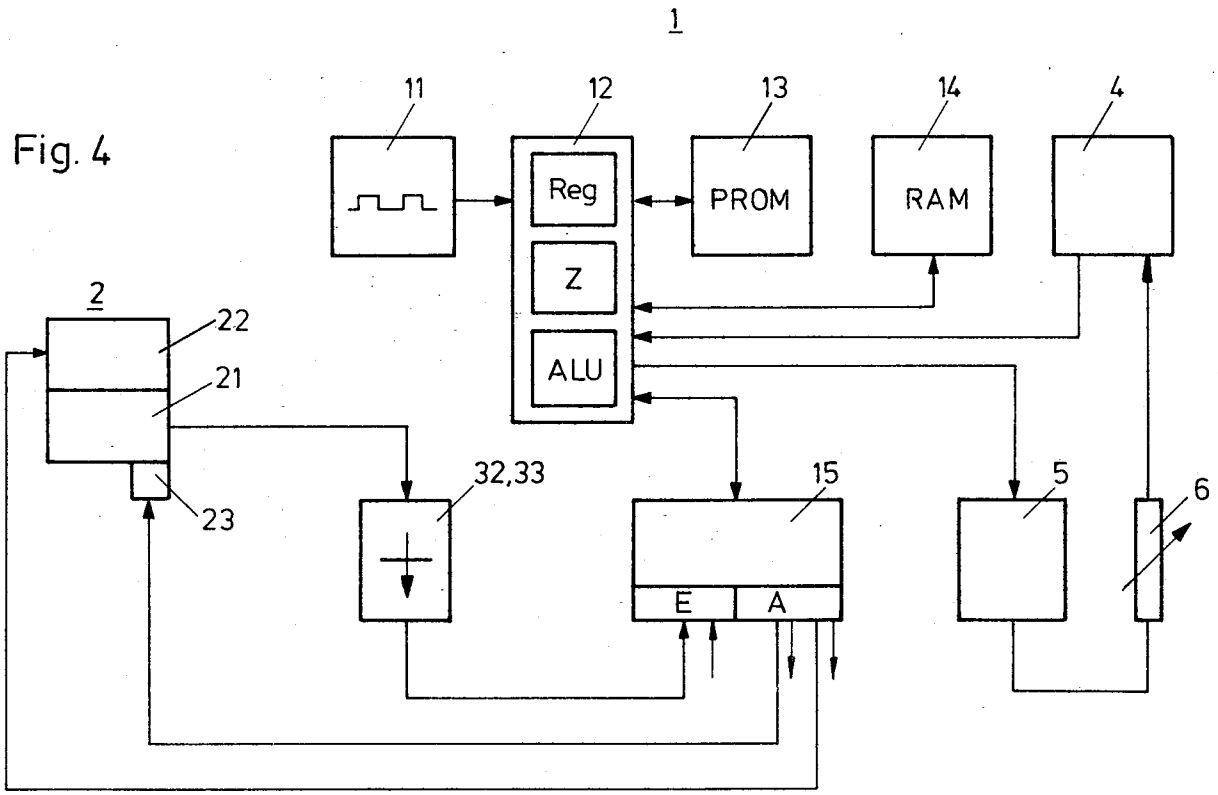
FIG. 4 is the block diagram of FIG. 3 in a more detailed illustration.

The circuit diagram illustrated in FIG. 4 shows a somewhat detailed variation of the block diagram of FIG. 3. The electronic control unit of this circuit diagram is divided into a timing or pulse generator 11, a central processor or a control/calculator mechanism 12, a programmable fixed value register or memory (PROM) 13, a recorder/reader storage means for random access memory (RAM) 14, as well as an input/output control 15. The programmable fixed value memory 13, the random access memory 14, as well as the input-/output control 15 are, by way of reciprocal or two-way data lines, connected with the central processor 12 which is controlled by the pulse generator 11. The probe 21 is connected with the input of the input/output control member 15 by way of the correction member 32, 33. The input/output member 15, at the output, is connected both with the control magnet 22 for the filling element 2, and also with a magnet 23 for the actuating device of a gas outlet valve. Finally, an automatic control system or control-loop connection exists between the central processor 12, a regulator 5, an adjustment member 6, as well as a member 4 for delivering the external parameters.

The operation and construction of this detailed circuit arrangement correspond extensively to the arrangement of FIG. 3. The arrangement of FIG. 4, however, provides the feedback of the external parameters to the operation of the central processor 12 and hence to the electronic calculator unit.

If more than 400 pulse cycles are transversed in a filling period, i.e. in the time of filling a container, respectively one pulse cycle can be used in defined or selected time intervals for transfer of information data about the operating condition of the filling element from the pulse cycle of the pulse control for forming a closed control circuit without essentially influencing the filling accuracy. In this way, a continuous data exchange between the rotating and the stationary parts of a filling machine is possible. Thus, it is possible to create a closed control circuit for one or more control devices associated with the filling machine in its stationary part or externally thereof, including for instance governors or pumps. In this way, suitable further indicator means can likewise indicate the particular operating conditions of the filling machine.

Figure 5:
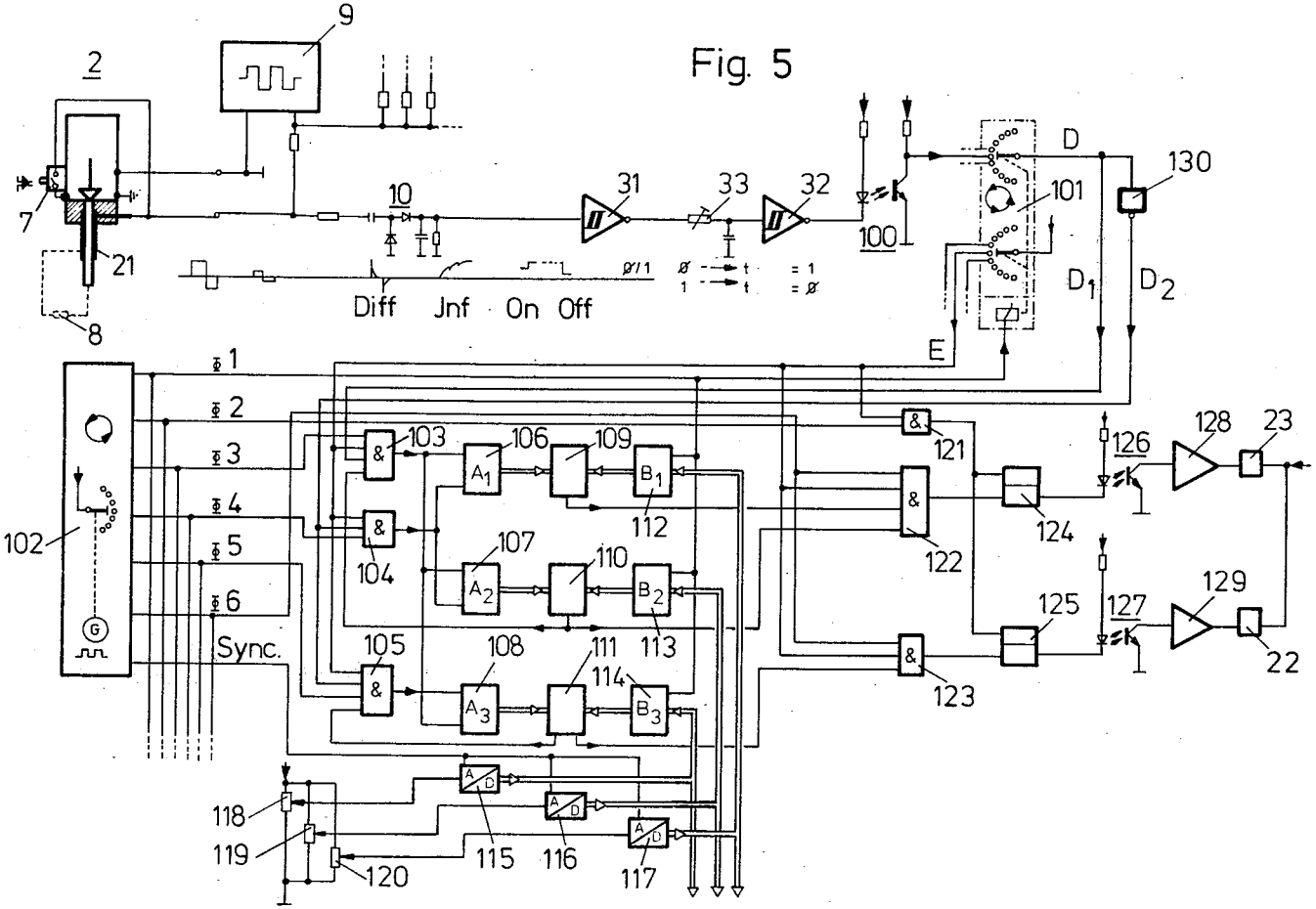
FIG. 5 is a further detailed representation of the block diagram of FIG. 4.

FIG. 5 shows a detailed circuit diagram for a plurality of filling elements, whereby one filling element 2 is shown as representative for all filling elements. At the filling element 2 there are provided a switch 7, which is operatively connected during the pressurizing zone, and a probe 21. The liquid resistance 8 is additionally represented by a dashed line. The outlet of the probe 21, and that of the remaining probes of the further filling elements of the rotating counterpressure filling machine, is connected with a frequency generator 9. Additionally, the outlet of the probe 21, and that of the remaining probes, is connected to the inlet of a probe amplifier 31 respectively associated with each probe by way of a differentiator and integration member 10. The probe amplifier 31 in turn is connected by way of a potentiometer 33 with the inlet of a correction amplifier 32. The outlet of this correction amplifier 32 in turn is connected by way of an optocoupler 100 with the first segment 101 of a pulse generator 101, 102.

With the assumed plurality of filling elements of the rotating counterpressure filling machine of this embodiment, the filling elements are divided into several groups, whereby each group with a selectable number of filling elements has a cycle or pulse generator 101, 102 allotted thereto. The first section 101 of the pulse generator 101, 102, controlled by the signal $\Phi_1$ of the second section 102 of the pulse generator 101, 102, switches or advances from one filling element of the group to the next filling element, so that a working cycle encompasses all filling elements of one group. The several groups of filling elements of the counterpressure filling machine accordingly are cyclically operated independently of each other, whereby the beginning and the end of the cycles of the independent pulse or cycle controls for each individual group are brought into mutual agreement by synchronizing means. The working cycle of one group proceeds in such a way that consecutively each filling element is processed in individual cycle or pulse phases by way of the connection existing through the optocoupler 100 with the outlet of the probe 21, whereby the individual pulse or cycle phases are preset by the second section 102 of the pulse generator 101, 102, which inquires as to the particular operating conditions. The signals E and D exist at the outlet of the first section 101 of the cycle or pulse generator 101, 102, with the signal D being passed one time over a negation member 130. The signals E and D1, or D1, negated are put at the inlets of three AND gates 103, 104, 105 as indicated diagrammatically in the circuit diagram of FIG. 5. Additionally, the condition variables $\Phi_3$, $\Phi_4$ or $\Phi_5$ given off by the second section 102 of the pulse generator 101, 102 are applied to further inlets of these AND gates 103, 104 and 105. This second section 102 of the pulse generator 101, 102 controls the following operating conditions:

- $\Phi_1$ switching on of the filling element to be processed to the electronic control unit, and taking over of the preset data B1, B2, B3;
- $\Phi_2$ signal output to the magnets 22 or 23 for closing the liquid flow valve and the gas outlet valve;
- $\Phi_3$ comparison of the rated and actual values of time, when the probe is not occupied, for the purpose of energizing or de-energizing the magnet 23 of the gas outlet valve, if necessary addition of an actual-value time cycle pulse;
- $\Phi_4$ cancelation of the values of actual time for the magnet 23 of the gas outlet valve when the probe is occupied;
- $\Phi_5$ comparison of the values of rated time and actual time, with the probe occupied, for the magnet 22 of the liquid flow valve, if necessary addition of an actual-value-time cycle pulse;
- $\Phi_6$ signal output to the magnet 22 or magnet 23 of the gas outlet valve or liquid flow valve for maintaining the closing position or for reopening;
- SYNC synchronization line for taking on or receiving new parameters.

The signals $\Phi_2$ or $\Phi_6$, together with the output signal E of the first section 101 of the cycle or pulse generator 101, 102, are fed to three further AND gates 121, 122, 123 to which additionally output signals from three comparison or reference members 109, 110, 111 are supplied. These reference members 109, 110, 111 are loaded with the outputs of three actual-value members 106, 107, 108, or three rated value members 112, 113, 114. The inputs of the three rated-value members 112, 113, 114 of each filling element of the group are connected to the output for the signal $\Phi_1$ at the second section 102 of the cycle or pulse generator 101, 102. For the further filling elements of the group there are likewise connected the following:

(a) the AND gate 121 thereof is connected to the output of the signal $\Phi_2$;
(b) the AND gate 103 thereof is connected to the output of the signal $\Phi_3$;
(c) the AND gate 104 thereof is connected to the output of the signal $\Phi_4$;
(d) the AND gate 105 thereof is connected to the output of the signal $\Phi_5$; and finally,
(e) the AND gates 122 and 123 thereof are connected to the output of the signal $\Phi_6$.

While the outputs of the three AND gates 103, 104, 105 are applied cyclically to the actual valve members 106, 107, 108, to the inputs of the three rated-value members 112, 113, 114, which are associated with the representatively shown filling element 2 and are connected with the digital outputs of the three analog-digital-converters 115, 116, 117, there are connected the inputs of the three rated-value members 112, 113, 114 of each filling element of the group. The three analog-digital-converters 115, 116, 117, in contrast, are associated in common with all filling elements of the group. Additionally, the inputs of the three rated-value members 112, 113, 114 have the pulse signal $\Phi_1$ applied thereto, which signal advances to the respective next filling element to be processed. The analog inputs of the three analog-digital-converters 115, 116, 117 are connected to three potentiometers 118, 119, 120 which serve for setting or adjusting the particular external parameters.

The reference members 110, 111, aside from their signal output to the subsequently connected AND gates 122 and 123, additionally transmit signals to the first or third AND gates 103 or 105 connected ahead of them. The inputs of the two storage or memory-flip-flops 124 and 125 are connected to the output of the AND gate 121, while the inputs of the two memory-flip-flops 124 or 125 are connected with the outputs of the two AND gates 122 and 123.

The outputs of these two memory-flip-flops 124 and 125, in turn, are respectively connected by way of two optocouplers 126 and 127, as well as two amplifiers 128 and 129, with the magnet 23 for the gas outlet valve, or with the magnet 22 for the liquid flow valve of the filling element.

With this foregoing arrangement illustrated by the circuit diagram of FIG. 5, the following manner of operation can be attained:

As already set forth, the working cycle of each filling element group proceeds in such a manner that consecutively the operating condition for each filling element is determined in individual cycle or pulse phases. Time data are preset for the filling elements of all groups, and such time data are respectively valid for the processing of one filling element, and selectively valid for one working cycle. Hereby the following three time-data blocks are preset by way of the rated-value members 112, 113, 114:

- $B_1$ (rated-value-member 112)=time from the beginning of the filling until the beginning of the rapid filling;
- $B_2$ (rated-value-member 113)=time from the beginning of the filling until the end of rapid filling;
- $B_3$ (rated-value-member 114)=time from seizing or covering of the probe until closing of the filling element.

These times are analog set at the potentiometers 118, 119, 120, and are converted into hexa-decimal signals by way of the analog-digital converters 115, 116, 117. The processing course of a filling element corresponds for this filling element to one time cycle or pulse. The next time cycle is given at the renewed processing of this filling element after completion of a working cycle. The number of time cycles represents the time actual value which is given off from the actual-value members 106, 107, 108. Hereby the measuring circuit of each filling element is continuously in operation and during the processing or operation is selected and interrogated by way of the second section 102 of the cycle or pulse generator 101, 102.

For the inventive filling-height correction, the probe 21 of a filling element 2 is short circuited, upon attaining of the predetermined filling height, by the liquid resistance 8 caused by the liquid entering the container. The corrected filling height in the filling container is reached when, from the time of reaching the predetermined filling height, the correction time preset by means of the electronic control unit, and the preset time of the rated-value member 14 corresponding to the correction factor for the filling height, have elapsed. At this point in time the magnet 22 of the filling element closes the liquid flow valve, so that the actual filling height is attained with the liquid which continues to pass into the container.

The potentiometer 33 arranged between the probe amplifier 31 and the correction amplifier 32 serves for the correction of inaccuracies in the filling behavior and for correction of unavoidable tolerances of the electrical components in the measuring circuit associated with every filling element.

Figure 6:
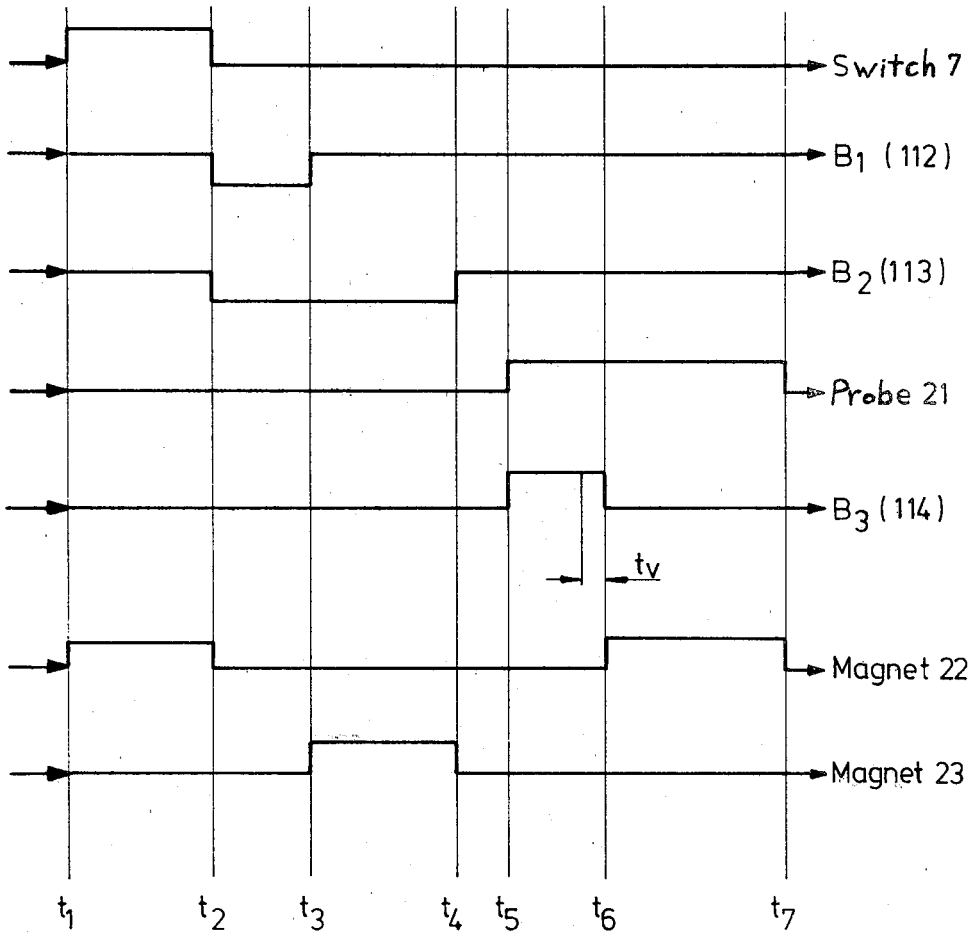
FIG. 6 is a chronological representation of the individual method steps with the control of an electrical filling element according to FIGS. 3, 4, and 5.

On the basis of the time sequence of the filling procedure below one filling element as represented in FIG. 6, the function of the circuit arrangement of FIG. 5 is explained. This illustration shows the chronological sequence of the signals which are dialed or selected by the central electronic control unit for the evaluations and control processes.

At the point of time $t_1$, where the pressurizing zone is reached, the switch 7 is closed, and the magnet 22 of the actuating device for the liquid flow valve is engergized or operatively connected so as to be effective for holding the liquid flow valve in the closed position. At the point of time $t_2$, where the pressurizing zone ends and the pressurizing pressure is reached, the switch 7 in turn is again opened, whereby the magnet 22 is de-energized and the liquid flow valve is released for occupying the open position. At the point of time $t_2$, simultaneously the magnet 23 for the gas outlet valve is energized or made effective with time delay by way of the rated-value member 112, and additionally the rated-value member 113 is prepared for de-energization of the magnet 23 within a preset time. At the point of time $t_3$, the magnet 23, which has become energized, switches the gas outlet valve into the open position for rapid filling of the container. At the point of time $t_4$, where the preparation time for the rated value member 113 has expired, the magnet 23 is de-energized and the gas outlet valve is closed. At the point of time $t_5$, the predetermined filling height is reached by the liquid in the container, so that the liquid resistance 8 seizes the probe 21 and the preset time $t_v$ of the rated-value member 114, including the time of the correction member 32, 33 is scanned or interrogated. At the point of time $t_6$, the signal output occurs after expiration of the interrogated time, by way of the memory 125, the optocoupler 127, and the amplifier 129 to the magnet 22 for closing the liquid flow valve. At the point of time $t_7$, the filling process is concluded after completion of venting of the container, so that the container is withdrawn from the filling element. The probe seizure is thus eliminated, so that the filling element is ready for filling of a subsequent container, and the operating conditions are scanned or interrogated anew in the foregoing manner.

The present invention is, of course, in no way restricted to the specific disclosure of the specification and drawings, but also encompasses any modifications within the scope of the appended claims.

What we claim is:

1. A method for control of a liquid flow valve of electrically controlled filling elements in filling machines for dispensing of liquids into filling containers to be filled via an actuating device for the liquid flow valve, said filling elements respectively including the liquid flow valve and at least one signal emitter which is responsive to the liquid at a predetermined filling height in a respective filling container, said method in combination including the steps of:

opening a respective liquid flow valve;

supplying a signal from the signal emitter to the actuating device for adjustment of the fluid flow valve; and after a response of said signal emitter, closing said liquid flow valve with a time delay to the actuating device of the fluid flow valve under the influence of a first correction factor.

2. A method according to claim 1, which includes the step of individually assigning said first correction factor to each individual filling element.

3. A method according to claim 1, which includes the step of assigning said correction factor to all of said filling elements.

4. A method according to claim 1, which includes the step of associating with said first correction factor in each individual filling element at least one other correction factor for other correction tasks to be fulfilled.

5. A method according to claim 4, which includes the steps of providing said at least one other correction factor for other correction tasks in a partial range assigned individually in each individual filling element, and providing said first correction factor in a partial range which is common for all of said filling elements.

6. A method according to claim 5, which includes the step of changing said correction-factor partial ranges as a function of external parameters.

7. A method in combination according to claim 1, which includes the steps of:

connecting the individual filling elements to an electronic control unit;

cyclically operating said filling elements under fixed-cycle control;

effecting a plurality of timing cycles within the time interval for filling a container from one of said filling elements;

assigning a correction factor to each filling element;

selectively tripping the time delay circuit by operation of said control unit;

providing rated value parameters;

comparing said rated value parameters in said control unit with the respectively detected actual values; and subjecting said time delay circuit to the influence of said rated value parameters.

8. A method for controlling electrically controlled filling elements of filling machines for filling containers with liquid, said filling elements respectively including a liquid flow valve and at least one signal emitter which is responsive to the liquid at a predetermined filling height in a respective container, said method including the steps of:

opening a respective liquid flow valve;

after a response of said signal emitter, closing said liquid flow valve with a time delay under the influence of a first correction factor, connecting the individual filling elements to an electronic control unit;

cyclically operating said filling elements under fixed-cycle control;

affecting a plurality of timing cycles within the time interval for filling a container from one of said filling elements;

assigning a correction element to each filling element;

providing at least one delay member, which are selectively tripped by said control unit and are associated with said correction element;

providing rated value parameters;

comparing said rated value parameters in said control unit with the respectively detected actual values;

subjecting said at least one delay member to the influence of said rated value parameters, and prescribing individual rated value parameters for each filling element.

9. A method in combination according to claim 7, which includes the step of prescribing rated value parameters in common for all of said filling elements.

10. A method according to claim 8, which includes the steps of changing the external parameters in every timing cycle, and taking over these changed parameters at the end of the cycle for the following timing cycle.

11. A method according to claim 10, which includes the step, within the time period for filling a container, of using one timing cycle in fixable time intervals for feedback transmission to said electronic control unit.

12. A method according to claim 11, which includes the steps of testing the parameters for changes and transmission errors by comparison with previously stored parameters, and undertaking said comparison by said electronic control unit.

13. A method according to claim 12, which includes the step of testing the transmitted data of one timing cycle for transmission disturbances by means of a two of three-comparison.

14. A method according to claim 12, which includes the step of transmitting data concerning the operating condition of said filling elements from the timing cycles to form a closed control circuit.

15. A method according to claim 14, which includes the steps of sequentially operating all of said filling elements, with an operating cycle including a group with a selectable number of filling elements, and synchronously operating several groups.

16. A method according to claim 15, which includes the step of providing for the filling elements of all groups the following three time-data blocks:

$B_1$—the time from the beginning of filling with a filling element until the beginning of rapid filling therewith;

$B_2$—the time from the beginning of filling until the end of the rapid filling; and $B_3$—the time from seizing of said signal emitter until closing of said liquid flow valve of said filling element.

17. A method according to claim 16, which includes the steps of effecting the operating sequence of a filling element to correspond to one timing cycle, and, after traversing an operating cycle, providing the next timing cycle with the renewed operating of a particular filling element, with the number of timing cycles representing the time-actual-value.

18. A system for control of a liquid flow valve of electrically controlled filling elements in filling machines for dispensing of liquids into filling containers to be filled via an actuating device for the liquid flow valve, said filling elements respectively including the liquid flow valve and at least one signal emitter which is responsive to the liquid at a predetermined filling height in a respective filling container, said system in combination including:

a correction element associated with each filling element and connected to said signal emitter; and a control unit including the actuating device for the liquid flow valve, the output signal of said correction element being supplied to the actuating device for adjustment of the fluid flow valve during acting on said control unit, and said control unit acting on said liquid flow valve so that after a response of the signal emitter there is closing of said liquid flow valve with a time delay to the actuating device of the fluid flow valve under the influence of a first correction factor.

19. A system according to claim 18, in which said correction element is manually adjustable and includes several correction members.

20. A system in combination according to claim 19, in which one of said several correction members has assigned thereto the factor "time" as a correction factor, said remaining correction members having respectively assigned thereto a different correction task, including equilibration with the remaining filling elements.

21. A system in combination according to claim 19, in which said control unit is common for all of said filling elements, and in which at least one of said several correction members of said correction element associated with each filling element is selectively controlled by the control signals of said control unit.

22. A system in combination according to claim 19, in which one correction element having at least one correction member is assigned in common to all of said filling elements, and in which one common control unit is assigned thereto for actuating said correction members.

23. A system for control of a liquid flow valve of electrically controlled filling elements in filling machines for dispensing of liquids into filling containers to be filled via the liquid flow valve, said filling elements respectively including the liquid flow valve and at least one signal emitter which is responsive to the liquid at a predetermined filling height in a respective filling container, said system in combination including:

a correction element;

an electronic control unit, said signal emitter being connected with both said correction element and said control unit so that after a response of the signal emitter there is closing of said liquid flow valve with a time delay under influence of a correction factor;

an actuating device, including a first magnet, for said liquid flow valve of said filling element, the output side of said correction element being connected to said first magnet;

a gas outlet valve associated with said filling element; and an actuating device, including a second magnet, for said gas outlet valve, the output side of said correction element being connected to said second magnet, with the input side of said correction element being connected to said control unit.

24. A system for controlling electrically controlled filling elements of filling machines for filling containers with liquid, said filling elements respectively including a liquid flow valve and at least one signal emitter which is responsive to the liquid at a predetermined filling height in a respective container, said system including:

a correction element;

an electronic control unit, said signal emitter being connected with both said correction element and said control unit;

an actuating device, including a first magnet, for said liquid flow valve of said filling element, the output side of said correction element being connected to said first magnet;

a gas outlet valve associated with said filling element;

an actuating device, including a second magnet, for said gas outlet valve, the output side of said correction element being connected to said second magnet, with the input side of said correction element being connected to said control unit, said electronic control unit including an input/output control member, a central processor connected to said input/output control member by means of a data delivery and feedback line, and a cycle generator for controlling said central processor, said signal emitter being connected with the input of said input/output control member by means of said correction element, and the output side of said input/output control member actuating both said first magnet of said liquid flow valve and said second magnet for said gas outlet valve.

25. A system according to claim 24, in which said electronic control unit further includes a programmable fixed value memory and a random access memory, both of which are connected to said central processor.

26. A system according to claim 25, in which said electronic control unit further includes a regulator connected to said central procesor, an adjustment member connected to said regulator, and a parameter emitter connected to said adjustment member, and to the input of said central processor.

27. A method for controlling a liquid flow valve used in electrically controlled filling elements for filling containers, wherein each filling element includes an actuator for operating the flow valve and a signal emitter which emits a signal upon detecting that the liquid has reached a predetermined level in a container being filled, the method comprising the steps of:

setting the predetermined level at a level less than the full level of the container;

operating the actuator to open the flow valve to start filling the container;

emitting the signal upon the liquid reaching the predetermined level;

activating a time delay circuit with the initiating signal while continuing to fill the container;

influencing the length of the time delay interval with a correction factor selected to provide a uniform fill; and providing an output signal from the time delay circuit to the actuator after the time delay interval has expired, which output signal causes the actuator to close the valve to thereby cease filling the container.

* * * * *